US006651673B2

(12) United States Patent
Heitmann

(10) Patent No.: US 6,651,673 B2
(45) Date of Patent: Nov. 25, 2003

(54) COLLECTING RECEPTACLE FOR USE IN TOBACCO-PROCESSING MACHINES

(75) Inventor: Uwe Heitmann, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 109 days.

(21) Appl. No.: 09/729,100

(22) Filed: Dec. 5, 2000

(65) Prior Publication Data

US 2001/0003391 A1 Jun. 14, 2001

(30) Foreign Application Priority Data

Dec. 11, 1999 (DE) ..... 199 59 821

(51) Int. Cl.[7] ..... A24C 1/00
(52) U.S. Cl. ..... 131/96; 131/280
(58) Field of Search ..... 131/96, 280; 220/23.9, 220/485, 491, 495.01; 280/47.34

(56) References Cited

U.S. PATENT DOCUMENTS

| | | | | | |
|---|---|---|---|---|---|
| 1,678,839 | A | * | 7/1928 | Wilkins | |
| 2,960,347 | A | * | 11/1960 | Centa | |
| 3,255,905 | A | * | 6/1966 | Cochran | |
| 3,280,988 | A | * | 10/1966 | Bennett | |
| 3,376,986 | A | * | 4/1968 | Farber | |
| 3,665,931 | A | * | 5/1972 | Mizzau | 131/21 |
| 3,774,930 | A | * | 11/1973 | Pravednekow | 280/47.24 |
| 3,858,929 | A | * | 1/1975 | Brescia | 280/47.12 |
| 4,127,202 | A | * | 11/1978 | Jennings et al. | 280/408 |
| 4,511,154 | A | * | 4/1985 | Daloisio | 280/47.26 |
| 5,029,740 | A | * | 7/1991 | Cox | 190/15.1 |
| 5,070,687 | A | * | 12/1991 | Schweigert | 298/6 |
| 5,224,635 | A | * | 7/1993 | Wise | 206/508 |
| D361,191 | S | * | 8/1995 | Kowalski et al. | D34/27 |
| 5,558,254 | A | * | 9/1996 | Anderson et al. | 220/23.86 |
| 5,558,485 | A | * | 9/1996 | Haynes | 414/421 |
| 5,611,554 | A | * | 3/1997 | Eckloff | 280/47.34 |
| 5,649,718 | A | * | 7/1997 | Groglio | 280/43.17 |
| 5,704,625 | A | * | 1/1998 | Presnell et al. | 220/23.4 |
| 5,816,591 | A | * | 10/1998 | Parker et al. | 220/908 |
| 5,823,550 | A | * | 10/1998 | Bennett et al. | 280/33.998 |
| 5,843,768 | A | * | 12/1998 | Lin et al. | 220/913 |
| 6,120,231 | A | * | 9/2000 | Christ et al. | 414/422 |
| 6,203,034 | B1 | * | 3/2001 | Houry | 220/769 |
| 6,286,657 | B1 | * | 9/2001 | Schnabel | 131/327 |
| D454,238 | S | * | 3/2002 | Skalka | |

FOREIGN PATENT DOCUMENTS

| | | | | |
|---|---|---|---|---|
| DE | 2454724 | * | 5/1976 | B26B/3/00 |
| DE | 3903265 | * | 7/1989 | B26B/3/00 |
| FR | 2418730 | * | 11/1979 | B26B/3/00 |
| JP | 5085366 | * | 4/1993 | B26B/11/00 |
| RO | 105888 | * | 1/1989 | |

* cited by examiner

*Primary Examiner*—Steven P. Griffin
*Assistant Examiner*—Carlos Lopez
(74) *Attorney, Agent, or Firm*—Venable; Robert Kinberg; Chad C. Anderson

(57) ABSTRACT

In an arrangement of a collecting receptacle integrated into a production machine in the tobacco-processing industry for collecting tobacco products sorted out from the production machine during a production process, the collecting receptacle is removable from the production machine and is comprised of two parts.

14 Claims, 2 Drawing Sheets

COLLECTING RECEPTACLE FOR USE IN TOBACCO-PROCESSING MACHINES

CROSS-REFERENCE TO RELATED APPLICATIONS

Priority is claimed herein with respect to application No. 199 59 821.5 filed in Germany on Dec. 11, 1999, the disclosure of which is incorporated herein by reference.

BACKGROUND OF THE INVENTION

The invention relates to receptacles for collecting tobacco products, removed during the production process, which receptacles are integrated into a production machine used in the tobacco-processing industry, in particular a filter-attaching machine.

Production monitoring devices are installed on cigarette-production machines, in particular filter-attaching machines. These devices test the articles during successive production and packaging stages to detect various production defects. The devices furthermore transfer defective articles, for example with the aid of blowing air, into collecting receptacles that are also called rejection boxes, which are regularly removed from the machine and emptied.

SUMMARY OF THE INVENTION

It is an object of the invention to design receptacles of the type mentioned above so way that they are easier to handle, while simultaneously ensuring the required stability.

The above and other objects are accomplished according to the invention by the provision of an arrangement of a collecting receptacle integrated into a production machine in the tobacco-processing industry for collecting tobacco products sorted out from the production machine during a production process, wherein the collecting receptacle is removable from the production machine and is comprised of two parts.

Thus, according to the invention, the highest possible stability and simultaneously an easy to handle design without requiring additional auxiliary means is effected by the provision of a collecting receptacle that comprises a stable, rollable carriage part and a structurally lightweight, thin-walled receptacle insert that can be removed from the carriage part. With an arrangement of this type, it is further conceivable that the carriage part be delimited by three side walls so that the receptacle insert can be pulled sideways from the carriage.

However, a modification of the exemplary embodiment is preferred to facilitate the collecting and removal of loose tobacco particles that drop. According to the modification, the receptacle insert can be lifted out of inserted from the top into the carriage part.

To further reduce the inherent weight of a receptacle insert of this type, which can be lifted out, it is also possible for the receptacle insert to be provided with grid-type side walls.

The receptacle insert according to another embodiment rests on a carriage bottom and is adjacent carriage side walls that are designed to be sound absorbing to reduce radiating noise levels that are concentrated in the lower machine region despite the light-weight construction.

According to another aspect of the invention, several side-by-side arranged receptacles are provided so that the inserts are respectively delimited by three absorption surfaces of the associated carriage part and a fourth absorption surface of the respectively adjacent carriage part to permit the highest possible collection volume for the receptacle inserts.

According to yet another aspect of the invention the sound damping effect can be improved by designing the outer absorption surfaces of the collecting receptacle as a perforated plate. In that way, the wall-thickness reduction of the absorption material allows a further increase in the collection volume of the receptacle inserts.

The advantage achieved with the invention is that even full receptacles can be pulled, in a first step and without problem, from the machine and the separate inserts, of low inherent weight can be emptied in a second step without problem by turning them upside down.

BRIEF DESCRIPTION OF THE DRAWINGS

The invention is explained in further detail in the following with the aid of an exemplary embodiment shown in the drawing.

DETAILED DESCRIPTION OF THE INVENTION

Figure 1:
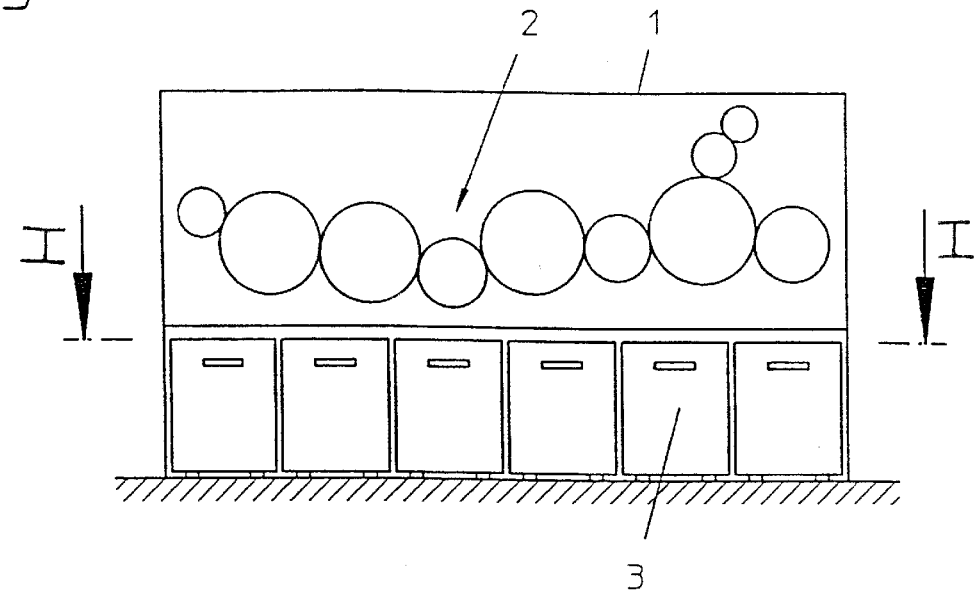
FIG. 1 is a schematic side elevation view of a filter-attaching machine used in the tobacco-processing machine used in the tobacco-processing industry, incorporating the collecting receptacle of the present invention.

Referring to FIG. 1, there is shown a filter-attaching machine 1 for packaging filtered cigarettes. Filter packaging machine 1 is provided with several side-by-side arranged collecting receptacles 3 along a conveying section consisting of numerous conveying drums 2. Conveying receptacles 3 are arranged below conveying drums 2. Along the complete length of the conveying section, collecting receptacles 3 (also called rejection boxes), serve to collect filter cigarettes or components thereof, which have been removed from the production process, for example as rejected articles, or have dropped off the conveying drums during the production pauses.

Figure 4:
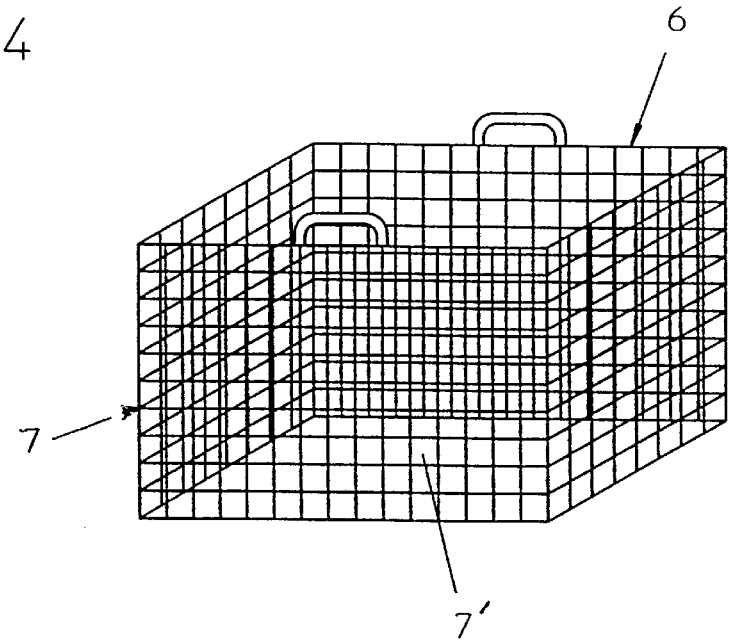
FIG. 4 is a collecting receptacle insert that has been lifted out.

Collecting receptacles 3 have a two-part design with an outer, relatively stable carriage part 4 that can roll and a relatively lightweight, thin-walled receptacle insert 6. The receptacle insert can be lifted out of carriage part 4 and, according to FIG. 4, is provided with grid-type side walls 7 and a solid bottom wall 7' comprised of, for example, sheet metal.

Figure 2:
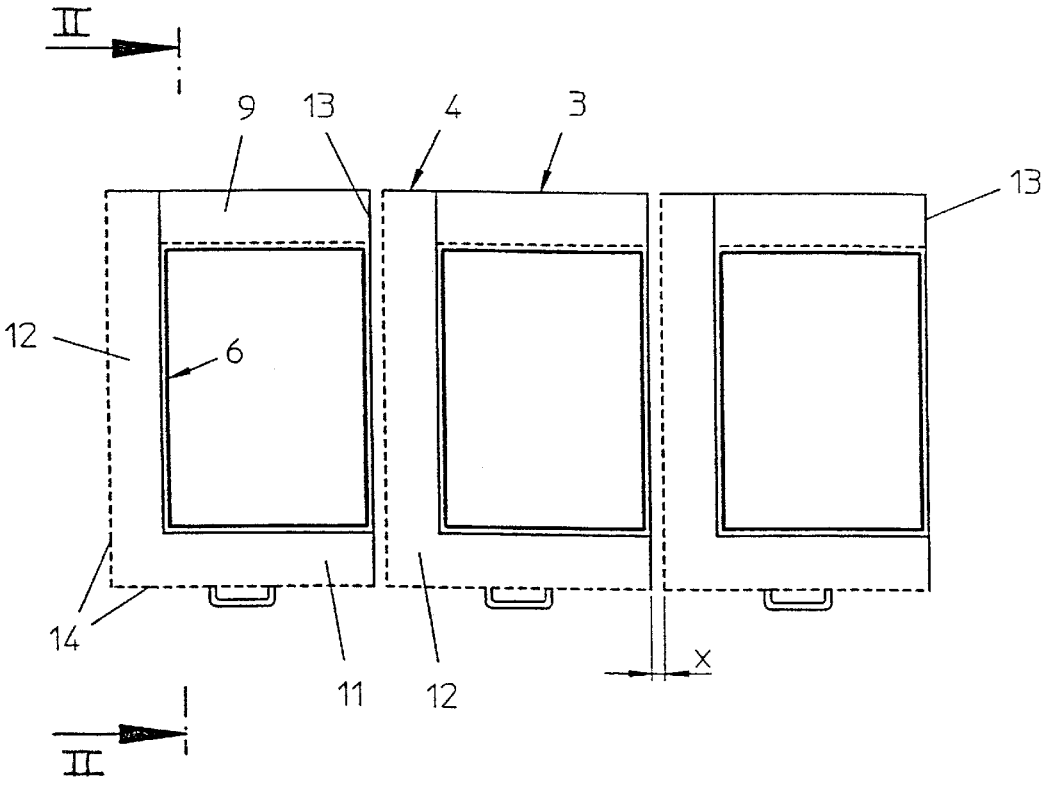
FIG. 2 is a plan view of a section of the collecting receptacle in the lower part of the filter-attaching machine, as seen along the line I—I in FIG. 1.

Each carriage part has a bottom wall 8 and three side walls 9, 11, 12, made of a sound-absorbing material, which delimit receptacle insert 6. A fourth side wall 13 of carriage part 4 is either open or, as for the exemplary embodiment, consists of a thin sheet-metal wall that is separated by a relatively narrow gap distance x of approximately 5 mm from a sound-absorbing side wall 12 of an adjacent carriage part 4 (see FIG. 2).

Figure 3:
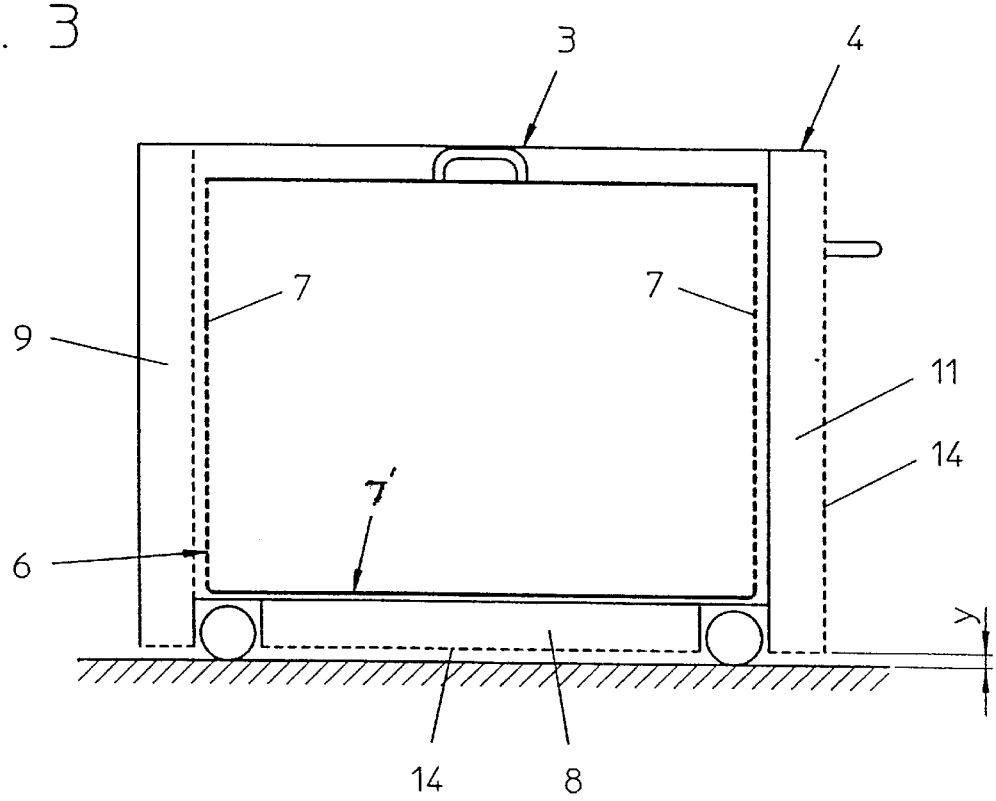
FIG. 3 is a longitudinal section through a collecting receptacle as seen along line II—II in FIG. 2.

An equally narrow gap distance y is provided between bottom wall 8 and the machine placement location on the ground, thereby creating a sound-damping effect (see FIG. 3). In addition, outer absorption surfaces of bottom wall 8 and side walls 9, 11, 12 are constructed of a perforated sheet metal 14.

A collecting receptacle 3 designed in this way can be pulled easily from the machine, even when it is filled, and its receptacle insert 6 can be lifted easily from the solid carriage part 4 and emptied.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. In an arrangement of collecting receptacles integrated into a production machine in the tobacco-processing industry for collecting tobacco products sorted out from the production machine during a production process, the improvement wherein the collecting receptacles are removable from the production machine and each receptacle is comprised of two parts, one part of the collecting receptacle being a stable, rollable carriage part and the other part is a lightweight, thin-walled receptacle insert that is removable from the carriage part, wherein the carriage part has a top and the receptacle insert is removable from and insertable into the carriage part from the top, wherein the carriage part includes a sound-absorbing bottom wall and sound-absorbing side walls, and the receptacle is located next to the sound-absorbing bottom wall and the sound-absorbing side walls, wherein the collecting receptacles are arranged side-by-side, each receptacle having at least two sound-absorbing side walls such that the receptacle inserts are respectively delimited by at least two absorption surfaces of the associated carriage part and another absorption surface of the respectively adjacent carriage part.

2. The arrangement according to claim 1, wherein the side-by-side collecting receptacles are arranged so that a narrow gap exists between adjacent side walls of adjacent collecting receptacles.

3. The arrangement according to claim 2, wherein the sound-absorbing bottom wall of each collecting receptacle is arranged to present a narrow gap between itself and the ground of an installation location.

4. The arrangement according to claim 3, wherein each of the gaps is approximately 5 mm.

5. The arrangement according to claim 2, wherein the gap is approximately 5 mm.

6. The arrangement according to claim 1, wherein the sound-absorbing walls each have an outer sound absorption surface comprised of a perforated sheet metal.

7. The arrangement according to claim 1, wherein the receptacle insert includes side walls comprised of a grid.

8. A collection container apparatus for integration into a production machine in the tobacco processing industry for tobacco articles rejected during a production process, the container comprising:

a plurality of stable, rollable carriages, each having a bottom wall and at least one side wall, at least one of the bottom wall and the at least one side wall being sound-absorbing; and a plurality of light-weight, thin walled container inserts removably arranged inside the carriages, wherein each of a plurality of receptacles is formed by one of the plurality of carriages and one of the plurality of inserts, the plurality of receptacles being arranged side-by-side, wherein each of the plurality of carriages include at least two of the sound-absorbing side walls, each of the plurality of inserts being respectively delimited by the at least two sound-absorbing side walls of the carriage and one of the sound-absorbing side walls of the carriage of an adjacent receptacle.

9. The collection container apparatus of claim 8, wherein the each of container inserts has side walls which include a grid.

10. The collection container apparatus of claim 8, wherein the sound-absorbing at least one of the bottom and at least one side wall has an outer sound absorption surface having a perforated metal sheet.

11. The collection container of apparatus claim 8, wherein the receptacles are arranged on a ground surface such that a narrow gap is formed between the bottom wall of the carriage and the ground surface.

12. The collection container apparatus of claim 11, wherein the gap is approximately 5 mm.

13. The collection container apparatus of claim 8, wherein the side-by-side receptacles are arranged such that a narrow gap is formed between adjacent side walls of adjacent carriages.

14. The collection container apparatus of claim 13, wherein the gap is approximately 5 mm.

* * * * *